United States Patent [19]

Lenzin et al.

[11] 4,134,193

[45] Jan. 16, 1979

[54] SURFACE-CLEANSING TOOL

[75] Inventors: Fritz Lenzin, Kilchberg; Joachim Schubert, Eptingen, both of Switzerland

[73] Assignee: Von Arx AG Maschinenfabrik, Sissach, Switzerland

[21] Appl. No.: 810,986

[22] Filed: Jun. 29, 1977

[30] Foreign Application Priority Data

Jun. 30, 1976 [CH] Switzerland ..... 8341/76

[51] Int. Cl.[2] ..... B21C 43/00

[52] U.S. Cl. ..... 29/81 L

[58] Field of Search ..... 29/81 D, 81 L, 81 R; 173/138, 133

[56] References Cited

U.S. PATENT DOCUMENTS 3,359,611 12/1967 Kelley ..... 29/81 D 3,680,643 8/1972 Cameron et al. ..... 29/81 D X

*Primary Examiner*—Dorsey Newton

*Attorney, Agent, or Firm*—Karl F. Ross

[57] ABSTRACT

A cluster of pins, serving to clean the surface of a workpiece, are slidably mounted in bores of a guide plate which is spring-urged against a metallic anvil, with formation of a clearance between the plate and the anvil in which the heads of the pins can move. The anvil is periodically struck by a ram which is freely reciprocable in a tool housing surrounding the anvil and the guide plate, the housing being provided with a pistol grip carrying a trigger that controls admission of compressed air to a chamber at the rear of the housing which is intermittently vented by the advancing ram to a space communicating with the atmosphere via channels in the anvil and perforations of the guide plate, thereby cooling the movable parts of the tool. The guide plate consists of a hard but light-weight resinous material, specifically polyamide 6.

10 Claims, 1 Drawing Figure

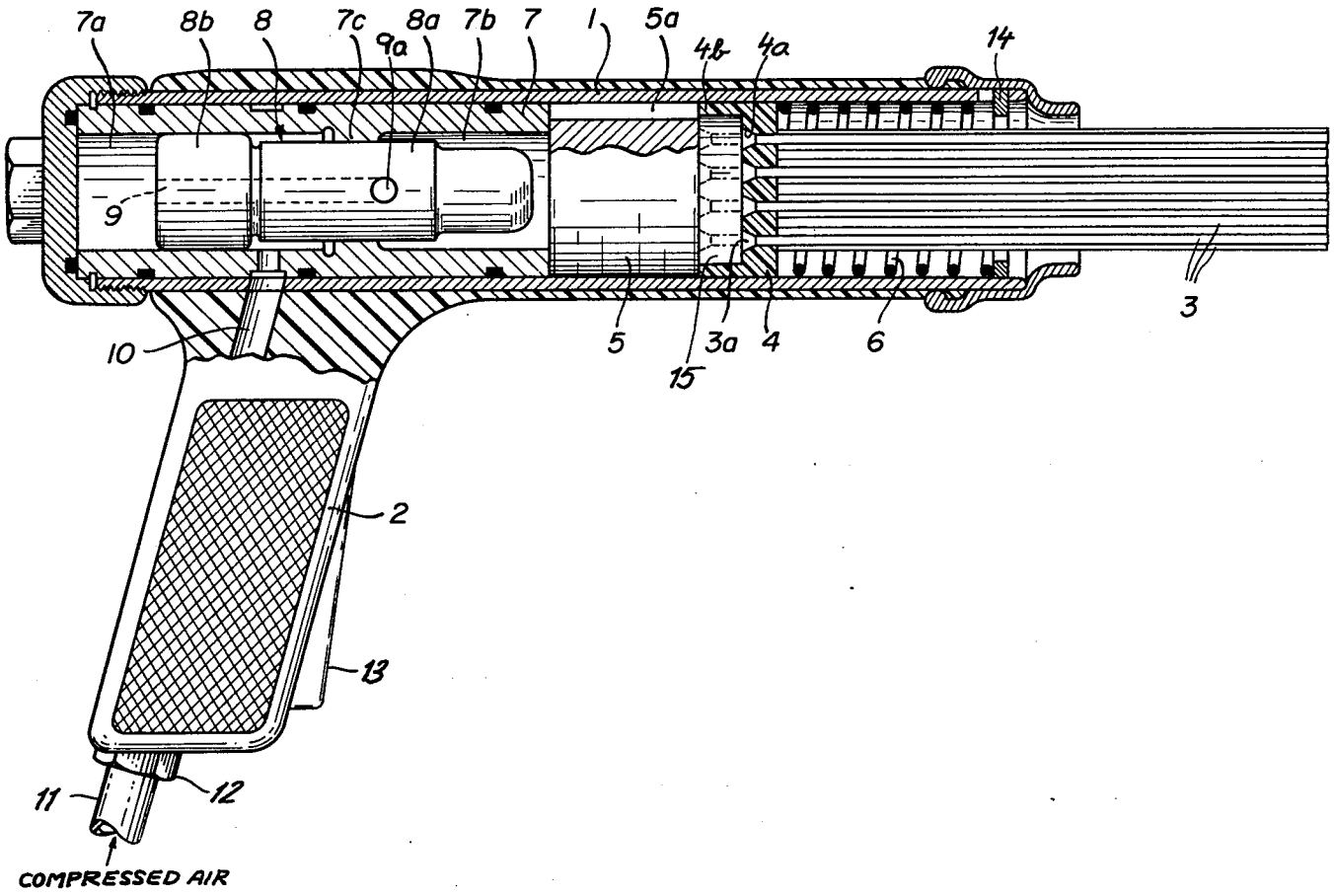
3
14
6
4a
4
4b
3a
15
5a
5
1
7
7b
8a
9a
7c
8
8b
7a
9
10
2
13
12
11
COMPRESSED AIR

SURFACE-CLEANSING TOOL

FIELD OF THE INVENTION

Our present invention relates to a tool for descaling or otherwise cleansing the surfaces of metallic and other workpieces.

BACKGROUND OF THE INVENTION

In U.S. Pat. No. 2,672,677 there has been described a descaling tool wherein a cluster of pins project from an open end of a tubular tool housing and are axially reciprocable, by pneumatic or other means, within a metallic guide plate which is limitedly displaceable in the direction of pin motion. The pins slide in respective bores of the guide plate and are rearwardly terminated by heads larger than these bores which are urged against the rear face of that plate by a resilient cushion, inserted between the guide plate and a reciprocating hammer, or by biasing springs individually bearing upon shoulders of the pins lying forwardly of the guide plate.

The high operating frequency of such a tool generates frictional and other forces which on the one hand lead to an early destruction of the pins and on the other hand cause a gradual widening of the bores of the guide plate. Thus, the needles were found to break at their heads within a few tens of hours of operation.

OBJECTS OF THE INVENTION

The general object of our present invention, therefore, is to provide an improved tool of this character which has a longer service life than similar tools known up to now.

Another object is to provide a tool of increased operating efficiency for the purpose set forth.

SUMMARY OF THE INVENTION

These objects are realized, in accordance with our present invention, by the provision of a metallic anvil linearly reciprocable in the tool housing, the anvil cooperating with a light-weight guide plate slidably tranversed by the cleansing pins. The enlarged heads of the pins are received in a clearance formed between the guide plate and the anvil by spacing means constituted, for example, by a skirt integral with the guide plate; the latter is urged rearwardly by resilient means such as a coil spring to maintain contact with the anvil. Upon reciprocation of the anvil by suitable drive means, preferably of the pneumatic type, the heads of the pins pressed against the anvil by a work-piece to be cleansed are propelled forwardly, i.e. toward the guide plate, so as to move freely within the intervening clearance.

We have found, in accordance with a further feature of our invention, that a high operating efficiency and a long service life can be attained by making the light-weight guide plate from a hard resinous material which should have an energy-absorption limit of at least 10 kilogram-meters per cubic centimeter, a flow temperature of at least 100° C and an impact resistance at least equal to 50 kilogram-meters per square centimeter. An outstanding resinous material satisfying these desiderata is polyamide 6.

BRIEF DESCRIPTION OF THE DRAWING

The above and other features of our invention will now be described in detail with reference to the accompanying drawing the sole FIGURE of which shows, in an elevational view and partly in axial section, a surface-cleansing tool representing a preferred embodiment.

SPECIFIC DESCRIPTION

As shown in the drawing, a surface-cleansing tool according to our invention comprises a tubular housing 1 provided with a handgrip 2. A bundle of substantially parallel pins or rods 3 of tempered steel project from the open front end of the housing. These pins are slidably lodged in bores **4*a* of a guide plate 4 and terminate in frustoconical heads 3*a*** which are receivable in correspondingly shaped rear extensions of these bores.

A skirt **4*b* integral with plate 4 is elastically urged into contact with a front face of a metallic anvil 5, preferably made of steel, by a coil spring 6 inserted between that plate and an inner peripheral shoulder 14 formed by a ring near the front end of tool housing 1. When the tips of the pins 3 are pressed against a workpiece surface to be cleansed, their heads 3*a* are forced into contact with anvil 5 as indicated in phantom lines. The individual biasing springs for these pins shown in the aforementioned U.S. Pat. No. 2,672,677 have been omitted since their presence has been found to be a cause of frequent pin breakage. Heads 3*a*, receivable in the enlarged ends of bores 4*a*, are freely movable within a clearance 15 defined by the skirt 4*b* between guide plate 4 and anvil 5**.

Anvil 5, backstopped by a cylindrical sleeve 7 inserted in housing 1, is freely slidable in the forward part of the housing to an extent determined by the compressibility of restoring spring 6. One or more longitudinal grooves **5*a* on the periphery of the anvil form channels for the escape of compressed driving air, as more fully described hereinafter, which are unblocked as soon as the anvil separates from the sleeve 7. This sleeve has a transverse partition 7*c* dividing its interior into a rear chamber 7*a* and a forward space 7*b*, the latter being normally closed by the anvil 5. Partition 7*c* has a central aperture accommodating the cylindrical body 8*a* of a hammer or ram 8 which has an enlarged head 8*b* slidable in chamber 7*a* and is freely reciprocable within sleeve 7. Ram 8 has an axial bore 9 extending forwardly from its head 8*a* and terminating at a cross-bore 9*a* which has the function of an air valve and in the illustrated ram position communicates with space 7*b*; with the ram fully retracted, that cross-bore opens into chamber 7*a***.

A conduit 10, extending laterally from handgrip 2 to chamber **7*a*, is connected to a nonillustrated source of compressed air via a tube 11 and is secured to the handgrip by a fitting 12. The conduit includes a valve controlled by a trigger 13 on that handgrip. With anvil 5 at rest, ram 8 can advance only slightly from its illustrated position so that its head 8*a* always stays to the rear of conduit 10; thus, upon depression of trigger 13, high-pressure air drives the ram rearward until the cross-bore 9*a* enters the chamber 7*a* so that the air pressure is transmitted to the rear face of head 8*b*. Thanks to the difference in the areas of the two faces of this head, the ram is now driven forward past its illustrated position to strike the anvil 5 and propel the pins 3 to the right; as the anvil advances, the compressed air exiting from bore 9 into space 7*b* is allowed to escape from that space through the groove or grooves 5*a* of the anvil and through the multiplicity of bores 4*a* of guide plate 4 whose diameter slightly exceeds that of the pins 3. This air flow also serves to cool the movable parts of the tool, specifically the ram 7, the anvil 5**, the guide plate 4 and the pins 3, thereby increasing the service life of the assembly. At the end of the forward stroke, the head 8*b* of ram 8 cuts off the influx of compressed air whereupon spring 6, supported by the pressure of the workpiece against the pins 3, reverses the movement of plate 4 to restore its illustrated position. The cycle is then repeated.

Tests we have carried out with such a tool have shown that, if the guide plate 4 is made of polyamide 6, the life span of the pins is practically unlimited. The useful life of the guide plate itself is about equal to or longer than that of conventional steel plates used for this purpose, depending to a certain extent on its mode of manufacture. In principle, such guide plates can be made by injection-molding, by machining or by a combination of both. With injection-molding, the resinous powder should be pretreated for reducing to a minimum its moisture content which could interfere with the mechanical properties of the product. With at least partial machining, the service life of our improved guide plate may be up to twice as long as with conventional plates.

We also have determined that the efficiency of our improved tool is considerably increased. Thus, in order to descale a workpiece surface of 0.125 $m^2$, a cleansing period of 10 minutes and 50 seconds was required with a guide plate made of steel whereas its replacement by a plate of polyamide 6, under otherwise identical conditions, reduced that period to 7 minutes and 10 seconds.

Polyamide 6 is representative of a rather small class of resinous materials satisfying the aforestated desiderata. This explains, we believe, the apparent reluctance of the art to experiment with guide plates of plastic materials since it could not be expected that its performance would equal or exceed that of steel in protecting the associated pins against rupture.

The energy-absorption limit referred to above is defined as the energy of deformation absorbed by a test object up to the point of rupture and can be determined by multiplying the maximum tensile strength of the material by the extent of its deformation on rupture. This energy-absorption limit is about 10 $kg.m/cm^3$ for the steel conventionally used in such guide plates, a value which therefore has been chosen by us as the threshold in determining the suitability of a synthetic resin for that purpose. In the case of polyamide 6, the corresponding value ranges between 15 and 20 $kg.m/cm^3$.

The threshold of 100° C for the flow temperature has been selected on the basis of the temperatures generally encountered in the use of surface-cleansing tools of the type here envisaged, i.e. the heating of the guide plate due on the one hand to its friction with the pins and on the other hand to the transformation of the sustained impacts into thermal energy. The flow temperature of polyamide 6 is on the order of 200° C.

The third criterion, namely the impact resistance, is also important. This parameter can be determined in various ways, the method most commonly used employing a pendulum of known mass striking a notched test object; the potential energy retained by the pendulum after its collision with the test object is a measure of the impact resistance. The test object may or may not break in that collision, depending on its impact resistance and on the extent of its notching. Tests performed according to the standard established by DIN53453 yielded values, expressed in $kg.cm/cm^2$, of 100 for polyamide 6 (nylon), 9 to 10 for Delrin and 2 to 3 for polyvinylchloride. Filled plastics containing lubricants have an even lower impact resistance. Thus, polyamide 66 loaded with $MoS_2$ has a resistance of about 15 to 20; without the lubricant, its impact resistance approximates that of polyamide 6.

All these tests were carried out with pins of tempered steel.

The low specific weight of our resinous guide plate is also an important advantage. As a result, the mass of the plate 4 is similar to that of an individual pin 3 whereby the guide plate and the pins tend to move together as a unit. Thanks to the reduced inertia of the guide plate, as well as to the absence of individual biasing springs for the pins, the stresses encountered by the heads 3*a* are minimized; this eliminates a major cause for the rupture of the pins in the conventional tools. The greater yieldability of the plastic material significantly attenuates the random vibrations generated on impact, as compared with metallic guide plates. The reduced vibration amplitudes undoubtedly account for the relatively long service life of the plastic guide plate which may exceed that of a steel plate by a factor of 2.

Finally, the low inertia of the reciprocating guide plate minimizes the energy loss incurred upon an advance of the plate against the countervailing force of its restoring spring 6. Thus, the stroke of the guide plate is shorter and the compression of the spring is less, which explains the observed increase in the efficiency of the present tool. The shortened stroke, in turn, diminishes the rate of consumption of compressed air; while we have not made any quantitative measurements of that reduction, it is safe to state that there is a significant reduction in the overall expenditure of driving energy for our improved tool.

A not inconsiderable saving in manufacturing cost is likewise inherent in the use of plastic instead of metallic guide plates.

The reciprocating ram 8 could also be driven by other means, e.g. electromagnetically as in conventional percussion tools. The described pneumatic arrangement, however, offers the additional advantage of effective cooling as already noted.

If no workpiece restrains the rightward movement of the pins 3, the impact of the anvil 5 and the subsequent repression of the guide plate 4 by the spring 6 establishes the solid-line position in which the heads 3*a* are received in the bore ends 4*a* in which they are held by the air pressure. With the compressed air within space 15 thus prevented from escaping, the reciprocation of ram 8 is halted and prevents the wasteful expenditure of energy even if the trigger 13 is pressed. Thus, the tool will become operative only when brought to bear upon a surface to be cleansed.

We claim:

1. A surface-cleansing tool comprising:

a tubular housing with an open front end;

a metallic anvil linearly reciprocable in said housing;

a light-weight cylindrical guide plate of a hard resinous material in said housing between said anvil and said front end, said resinous material having an energy-absorption limit of at least 10 kilogram-meters per cubic centimeter, a flow temperature of at least 100° C and an impact resistance at least equal to 50 kilogram-centimeters per square centimeter, said guide plate being provided with a multiplicity of generally parallel bores;

resilient means urging said guide plate rearwardly toward said anvil;

spacing means holding said guide plate separated from said anvil against the force of said resilient means, with formation of a clearance therebetween;

a set of metallic pins slidably lodged in said bores and projecting from said front end, said pins being provided with enlarged heads received in said clearance, said guide plate having a mass approximately equal to that of each of said pins; and drive means including a reciprocable ram in said housing rearwardly of said anvil for iteratively striking said guide plate through the intermediary of said anvil, thereby entraining said pins with a lag determined by said clearance and substantially in unison with said guide plate.

2. A tool as defined in claim 1 wherein said spacing means comprises a skirt integral with said guide plate.

3. A tool as defined in claim 1 wherein said housing is provided with an inner peripheral shoulder in the vicinity of said front end, said resilient means comprising a compression spring surrounding said pins while bearing upon said shoulder and said guide plate.

4. A tool as defined in claim 1 wherein said resinous material has an energy-absorption limit of 15 to 20 kilogram-meters per cubic centimeter, a flow temperature of approximately 200° C and an impact resistance of approximately 100 kilogram-centimeters per square centimeter.

5. A tool as defined in claim 4 wherein said resinous material is polyamide 6.

6. A surface-cleansing tool comprising:

a tubular housing with an open front end;

a metallic anvil linearly reciprocable in said housing;

a light-weight guide plate in said housing between said anvil and said front end, said guide plate being provided with a multiplicity of generally parallel bores;

resilient means urging said guide plate rearwardly toward said anvil;

spacing means holding said guide plate separated from said anvil against the force of said resilient means, with formation of a clearance therebetween;

a set of pins slidably lodged in said bores and projecting from said front end, said pins being provided with enlarged heads received in said clearance; and drive means for reciprocating said anvil together with said guide plate, thereby entraining said pins with a lag determined by said clearance, said drive means including a source of compressed gas and a ram rearwardly of said anvil freely reciprocable in said housing under pressure of said gas, said ram forming a valve for periodically venting said gas to the atmosphere while striking said anvil, the latter being provided with at least one channel for the escape of said gas upon forward displacement of said anvil from a normal position, said housing being provided with an abutment blocking said channel in said normal position.

7. A tool as defined in claim 6 wherein said guide plate consists of a hard resinous material.

8. A tool as defined in claim 7 wherein said resinous material has an energy-absorption limit of at least 10 kilogram-meters per cubic centimeters, a flow temperature of at least 100° C and an impact resistance at least equal to 50 kilogram-centimeters per square centimeter.

9. A tool as defined in claim 6 wherein said bores surround said pins with sufficient clearance to give passage to the escaping gas by way of said front end.

10. A tool as defined in claim 9 wherein said pins have heads receivable in enlarged rear extremities of said bores in an advanced pin position for blocking the escape of the gas in the absence of a countervailing force acting upon the projecting tips of said pins.

* * * * *